US010107226B2

(12) United States Patent
Komori et al.

(10) Patent No.: US 10,107,226 B2
(45) Date of Patent: Oct. 23, 2018

(54) FUEL PRESSURE CONTROL DEVICE

(71) Applicant: TOYOTA JIDOSHA KABUSHIKI KAISHA, Toyota-shi, Aichi-ken (JP)

(72) Inventors: Keisuke Komori, Okazaki (JP); Junpei Takahashi, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 36 days.

(21) Appl. No.: 15/387,058

(22) Filed: Dec. 21, 2016

(65) Prior Publication Data

US 2017/0184045 A1 Jun. 29, 2017

(30) Foreign Application Priority Data

Dec. 25, 2015 (JP) ..... 2015-255170

(51) Int. Cl.

| | |
|---|---|
| ***F02D 41/38*** | (2006.01) |
| ***F02M 59/36*** | (2006.01) |
| ***F02M 59/10*** | (2006.01) |
| ***F02M 59/46*** | (2006.01) |
| ***F02D 41/12*** | (2006.01) |
| *F02M 63/02* | (2006.01) |
| *F02D 41/20* | (2006.01) |

(52) U.S. Cl.

CPC ..... *F02D 41/3836* (2013.01); *F02D 41/123* (2013.01); *F02D 41/3845* (2013.01); *F02D 41/3854* (2013.01); *F02D 41/3863* (2013.01); *F02M 59/102* (2013.01); *F02M 59/368* (2013.01); *F02M 59/462* (2013.01); *F02M 59/466* (2013.01); *F02D 2041/2024* (2013.01); *F02M 63/023* (2013.01); *F02M 63/0225* (2013.01); *F02M 63/0265* (2013.01)

(58) Field of Classification Search

CPC ..... F02D 41/3836; F02D 41/3845; F02D 41/3854; F02D 41/3863; F02D 41/123; F02M 59/368; F02M 59/462; F02M 59/466

USPC ..... 123/294, 495

See application file for complete search history.

(56) References Cited

U.S. PATENT DOCUMENTS

| | | | | |
|---|---|---|---|---|
| 5,526,790 | A * | 6/1996 | Augustin | F02D 41/3863 123/456 |
| 5,642,716 | A * | 7/1997 | Ricco | F02D 41/3809 123/447 |
| 6,105,554 | A | 8/2000 | Nishiyama | |
| 9,816,473 | B2 * | 11/2017 | Kraft | F02M 59/466 |
| 2011/0232610 | A1 * | 9/2011 | Okamoto | F02D 41/3863 123/495 |

FOREIGN PATENT DOCUMENTS

| | | |
|---|---|---|
| JP | H10-54318 A | 2/1998 |
| JP | H10-281036 A | 10/1998 |

(Continued)

*Primary Examiner* — Mahmoud Gimie
(74) *Attorney, Agent, or Firm* — Oliff PLC

(57) ABSTRACT

A fuel pressure control device determines whether it is during a descending period of a plunger descending or an ascending period of the plunger ascending, and puts a first drive mechanism and a second drive mechanism in an energized state during the descending period and in a non-energized state during the ascending period, when there is a pressure reduction request to lower a fuel pressure in a high-pressure passage.

13 Claims, 13 Drawing Sheets

(56) References Cited

FOREIGN PATENT DOCUMENTS

| | | | | |
|---|---|---|---|---|
| JP | H11-82105 | A | 3/1999 | |
| JP | 2000-018067 | A | 1/2000 | |
| JP | 2000-136763 | A | 5/2000 | |
| JP | 2003-184611 | A | 7/2003 | |
| JP | 2008-008298 | A | 1/2008 | |
| JP | 2010-071132 | A | 4/2010 | |
| JP | 2011-149407 | A | 8/2011 | |
| JP | 2015-200322 | A | 11/2015 | |
| WO | WO 2013092367 | A1 * | 6/2013 | ..... F02M 59/462 |

* cited by examiner

FUEL PRESSURE CONTROL DEVICE

INCORPORATION BY REFERENCE

The disclosure of Japanese Patent Application No. 2015-255170 filed on Dec. 25, 2015 including the specification, drawings and abstract is incorporated herein by reference in its entirety.

BACKGROUND

1. Technical Field

Present embodiment relates to a fuel pressure control device.

2. Description of Related Art

In an internal combustion engine having a cylinder injection valve, a fuel pressurized with a low-pressure pump is further pressurized with a high-pressure pump, and the pressurized fuel is supplied to the cylinder injection valve through a high-pressure passage. In such an internal combustion engine, a fuel cut may be executed to temporarily stop fuel injection from the cylinder injection valve, for example. During the fuel cut, a high-pressure fuel in the high-pressure passage is not consumed, so that fuel pressure in the high-pressure passage may increase depending on the temperature of the fuel. As a result, the fuel pressure may become larger than a target fuel pressure when the internal combustion engine returns from the fuel cut. In this case, there is a possibility that a fuel injection amount in the cylinder injection valve, which receives fuel supply from the high-pressure passage, cannot appropriately be controlled.

Accordingly, for example in Japanese Patent Application Publication No. 10-54318 and Japanese Patent Application Publication No. 2010-71132, a technology for returning the fuel in the high-pressure passage to the fuel tank has been proposed in order to lower the fuel pressure in the high-pressure passage at the time of a pressure reduction request such as a fuel cut. Moreover, in Japanese Patent Application Publication No. 2000-18067, a technology has been proposed for continuing fuel injection until the fuel pressure in the high-pressure passage reaches a target fuel pressure when a fuel cut condition is satisfied.

However, the technology disclosed in JP 10-54318 A and JP 2010-71132 A requires a long relief passage for returning the fuel from the high-pressure passage to the fuel tank, which may cause increase in manufacturing costs. The technology disclosed in JP 2000-18067 A may cause a period of time from satisfaction of the fuel cut condition to execution of the fuel cut to be prolonged.

For example, in the technology of JP 2011-149407 A, a suction valve and a discharge valve are disposed on a low-pressure passage side and a high-pressure passage side of a compressing chamber of the high-pressure pump, respectively. The suction valve and the discharge valve can forcibly be opened by a single drive mechanism. In the technology disclosed in JP 2011-149407 A, both the suction valve and the discharge valve are opened by the drive mechanism so as to lower the fuel pressure in the high-pressure passage during the fuel cut.

SUMMARY

However, in the technology disclosed in JP 2011-149407 A, both the suction valve and the discharge valve are maintained in an opened state during the fuel cut. Accordingly, the fuel may be sucked from the low-pressure passage side to the compressing chamber through the suction valve in a period when a plunger of the high-pressure pump descends, and then the fuel may be discharged from the compressing chamber to the high-pressure passage side in a period when the plunger ascends. Such discharge of the fuel from the low-pressure passage side to the high-pressure passage side may hinder rapid reduction in fuel pressure in the high-pressure passage.

Accordingly, the present embodiment provides a fuel pressure control device that can rapidly reduce the fuel pressure inside the high-pressure passage.

A fuel pressure control device according to a first aspect of the present embodiment includes:

- a low-pressure pump configured to suck fuel in a fuel tank;
- a low-pressure passage configured to receive the fuel supplied from the low-pressure pump;
- a high-pressure pump configured to pressurize the fuel supplied from the low-pressure passage;
- a high-pressure passage configured to receive the fuel supplied from the high-pressure pump;
- a cylinder injection valve configured to receive the fuel supplied from the high-pressure passage to directly inject the fuel into a cylinder of an internal combustion engine, the high-pressure pump including a cylinder, a plunger configured to ascend and descend inside the cylinder in conjunction with driving of the internal combustion engine, a compressing chamber having a capacity decreased by the plunger ascending and increased by the plunger descending, a suction passage configured to provide communication between the low-pressure passage and the compressing chamber;
- a discharge passage configured to provide communication between the compressing chamber and the high-pressure passage, a first control valve provided in the suction passage, the first control valve being configured to permit or prohibit communication of the fuel between the low-pressure passage and the compressing chamber, a second control valve provided in the discharge passage, the second control valve being configured to permit communication of the fuel from the compressing chamber to the high-pressure passage, and the second control valve being configured to restrict communication of the fuel from the high-pressure passage to the compressing chamber, a first drive mechanism configured to open or close the first control valve by energization control, and a second drive mechanism configured to open or close the second control valve by energization control; and
- an electronic control unit configured to i) determine whether the plunger is in a descending period during which the plunger is descending or the plunger is in an ascending period during which the plunger is ascending, ii) cause the first control valve to be closed and the second control valve to be open by using the first drive mechanism and the second drive mechanism during the descending period when there is a pressure reduction request to lower a fuel pressure inside the high-pressure passage, and iii) cause the first control valve to be open and the second control valve to be closed by using the first drive mechanism and the second drive mechanism during the ascending period when there is the pressure reduction request.

With the first and second drive mechanisms being put in the energized state, the first control valve functions as a normal check valve, and the second control valve opens. Here, the capacity of the compressing chamber increases during the descending period of the plunger. Accordingly, when the first and second drive mechanisms are put in the energized state during the descending period, the fuel returns to the compressing chamber from the high-pressure passage side. As a result, the fuel pressure becomes higher on the compressing chamber side of the first control valve than on the low-pressure passage side, so that the first control valve is maintained closed. This makes it possible to suppress suction of the fuel from the low-pressure passage side to the compressing chamber and to return the fuel from the high-pressure passage side to the compressing chamber during the descending period. As a consequence, the fuel pressure in the high-pressure passage can be lowered.

With the first and second drive mechanisms being put in the non-energized state, the first control valve opens while the second control valve functions as a normal check valve. Here, the capacity of the compressing chamber decreases during the ascending period of the plunger. Accordingly, when the first and second drive mechanisms are put in the non-energized state during the ascending period, the fuel returns to the low-pressure passage side from the compressing chamber. As a result, the fuel pressure becomes lower on the compressing chamber side of the second control valve than on the high-pressure passage side, so that the second control valve is maintained closed. Therefore, discharge of the fuel from the compressing chamber side to the high-pressure passage is suppressed during the ascending period. As a consequence, increase in fuel pressure in the high-pressure passage is suppressed. Thus, the fuel pressure in the high-pressure passage can rapidly be lowered.

A fuel pressure control device according to a second aspect of the present embodiment includes:

a low-pressure pump configured to suck fuel in a fuel tank;

a low-pressure passage configured to receive the fuel supplied from the low-pressure pump;

a high-pressure pump configured to pressurize the fuel supplied from the low-pressure passage;

a high-pressure passage configured to receive the fuel supplied from the high-pressure pump;

a cylinder injection valve configured to receive the fuel supplied from the high-pressure passage to directly inject the fuel into a cylinder of an internal combustion engine, the high-pressure pump including a cylinder, a plunger configured to ascend and descend inside the cylinder in conjunction with driving of the internal combustion engine, a compressing chamber having a capacity decreased by the plunger ascending and increased by the plunger descending, a suction passage configured to provide communication between the low-pressure passage and the compressing chamber;

a discharge passage configured to provide communication between the compressing chamber and the high-pressure passage, a first control valve provided in the suction passage, the first control valve being configured to permit or prohibit communication of the fuel between the low-pressure passage and the compressing chamber, a second control valve provided in the discharge passage, the second control valve being configured to permit communication of the fuel from the compressing chamber to the high-pressure passage, and the second control valve being configured to restrict communication of the fuel from the high-pressure passage to the compressing chamber, a first drive mechanism configured not to press the first control valve in an energized state but to press and open the first control valve in a non-energized state, and a second drive mechanism configured not to press the second control valve in the non-energized state but to press and open the second control valve in the energized state; and an electronic control unit configured to i) determine whether the plunger is in a descending period during which the plunger is descending or the plunger is in an ascending period during which the plunger is ascending, ii) maintain the first drive mechanism in the non-energized state during both the descending period and the ascending period when there is a pressure reduction request to lower a fuel pressure inside the high-pressure passage, iii) put the second drive mechanism in the energized state during the descending period when there is the pressure reduction request, and iv) put the second drive mechanism in the non-energized state during the ascending period when there is the pressure reduction request.

With the second drive mechanism being put in the energized state during the descending period and in the non-energized state during the ascending period, the fuel returns from the high-pressure passage side to the compressing chamber during the descending period, and discharge of the fuel to the high-pressure passage side is suppressed during the ascending period. With the first drive mechanism being maintained in the non-energized state during both the descending period and the ascending period, the first control valve is constantly in the opened state. As a result, it becomes possible to return the fuel from the compressing chamber to the low-pressure passage side during the ascending period, while lowering power consumption of the first drive mechanism.

A fuel pressure control device according to a third aspect of the present embodiment includes:

a low-pressure pump configured to suck fuel in a fuel tank;

a low-pressure passage configured to receive the fuel supplied from the low-pressure pump;

a high-pressure pump configured to pressurize the fuel supplied from the low-pressure passage;

a high-pressure passage configured to receive the fuel supplied from the high-pressure pump;

a cylinder injection valve configured to receive the fuel supplied from the high-pressure passage to directly inject the fuel into a cylinder of an internal combustion engine, the high-pressure pump including a cylinder, a plunger configured to ascend and descend inside the cylinder in conjunction with driving of the internal combustion engine, a compressing chamber having a capacity decreased by the plunger ascending and increased by the plunger descending, a suction passage configured to provide communication between the low-pressure passage and the compressing chamber;

a discharge passage configured to provide communication between the compressing chamber and the high-pressure passage, a first control valve provided in the suction passage, the first control valve being configured to permit or prohibit communication of the fuel between the low-pressure passage and the compressing chamber, a second control valve provided in the discharge passage, the second control valve being configured to permit communication of the fuel from the compressing chamber to the high-pressure passage, and the second control valve being configured to restrict communication of the fuel from the high-pressure passage to the compressing chamber, a first drive mechanism configured to open or close the first control valve by energization control, and a second drive mechanism configured to open or close the second control valve by energization control; and an electronic control unit configured to i) determine whether the plunger is in a descending period during which the plunger is descending or the plunger is in an ascending period during which the plunger is ascending, ii) cause the first control valve to be closed by using the first drive mechanism during the descending period when there is a pressure reduction request to lower a fuel pressure inside the high-pressure passage, iii) cause the first control valve to be open by using the first drive mechanism during the ascending period when there is the pressure reduction request, and iv) maintain the second drive mechanism in the energized state during both the descending period and the ascending period when there is the pressure reduction request.

With the first drive mechanism being put in the energized state during the descending period and in the non-energized state during the ascending period, suction of the fuel from the low-pressure passage side to the compressing chamber is suppressed during the descending period, and the fuel can be returned to the low-pressure passage side from the compressing chamber during the ascending period. With the second drive mechanism being maintained in the non-energized state during both the descending period and the ascending period, the second control valve is kept constantly opened, so that the fuel can be returned to the compressing chamber from the high-pressure passage side. As a consequence, the fuel pressure in the high-pressure passage can rapidly be lowered.

The electronic control unit may be configured to start energization of the second drive mechanism within a latter half period of the ascending period and to put the second drive mechanism in the energized state during the descending period.

The electronic control unit may be configured to stop energization of the second drive mechanism during the descending period while putting the second drive mechanism in the non-energized state during the ascending period.

The first control valve may include a first valve body, a first valve seat portion having a first hole formed therein, the first valve seat portion being located at a position closer to the low-pressure passage than to the first valve body, and a first biasing portion configured to bias the first valve body to the first valve seat portion so as to close the first hole, the first drive mechanism may include a first needle facing the first valve body through the first hole, a first needle biasing portion configured to bias the first needle to the first valve body, and a first coil configured to be switched to the energized state or the non-energized state to drive the first needle, and the first needle may be configured such that the first needle is separated from the first valve body with magnetic force generated by the first coil in the energized state against biasing force of the first needle biasing portion and that the first needle presses the first valve body through the first hole so that the first valve body is separated from the first valve seat portion with the biasing force of the first needle biasing portion with the first coil in the non-energized state.

The second control valve may include a second valve body, a second valve seat portion having a second hole formed therein, the second valve seat portion being located at a position closer to the compressing chamber than to the second valve body, and a second biasing portion configured to bias the second valve body to the second valve seat portion so as to close the second hole, the second drive mechanism may include a second needle facing the second valve body through the second hole, a second needle biasing portion configured to bias the second needle so that the second needle is separated from the second valve body, and a second coil configured to be switched to the energized state or the non-energized state to drive the second needle, and the second needle may be configured such that the second needle presses the second valve body through the second hole so that the second valve body is separated from the second valve seat portion with magnetic force generated by the second coil in the energized state against the biasing force of the second needle biasing portion and that the second needle is separated from the second valve body with the biasing force of the second needle biasing portion with the second coil in the non-energized state.

According to the aspects of the present embodiment, it becomes possible to provide a fuel pressure control device that can rapidly reduce the fuel pressure in the high-pressure passage.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENT

Hereinafter, the embodiment of the present embodiment will be described with reference to the accompanying drawings.

Figure 1:
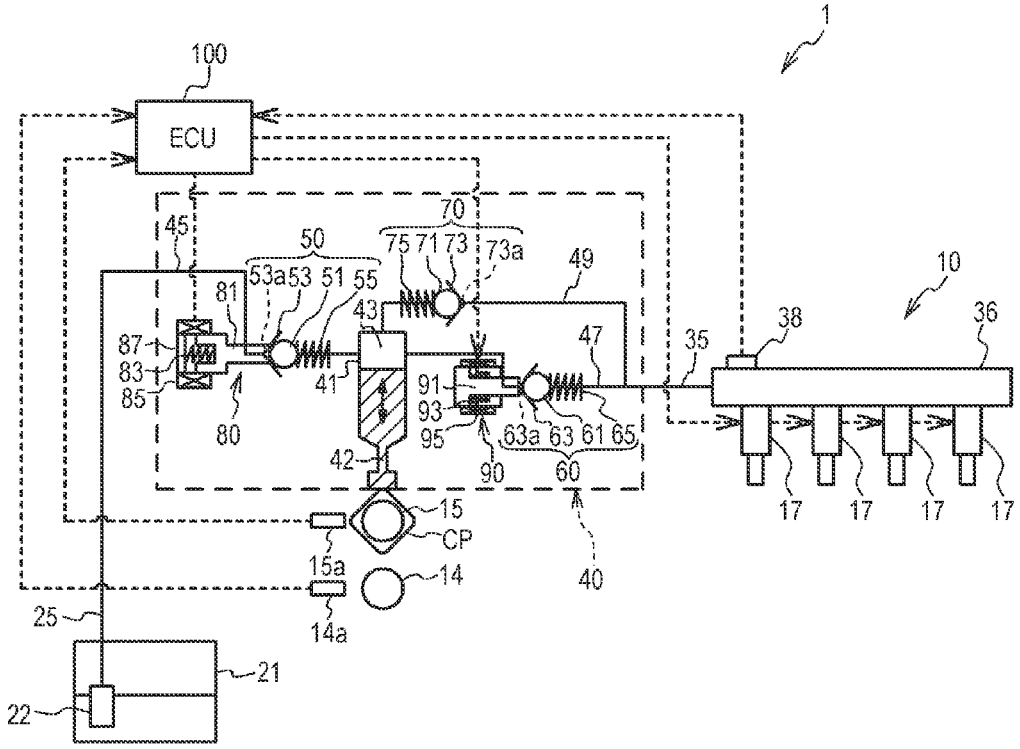
FIG. 1 is a schematic configuration view of a control device of the present embodiment.

FIG. 1 is a schematic configuration view of a control device 1 of the present embodiment. The control device 1 includes an engine 10, a high-pressure pump 40 configured to regulate the pressure of fuel supplied to the engine 10, an electronic control unit (ECU) 100 configured to control the engine 10 and the high-pressure pump 40, a fuel tank 21, a low-pressure pump 22, a low-pressure pipe 25, a high-pressure pipe 35, a delivery pipe 36, and a fuel pressure sensor 38. The control device 1 is one example of the fuel pressure control device.

The engine 10 is a spark ignition 4-cylinder engine including a cylinder injection valve 17. The engine 10 also includes a crankshaft 14 in conjunction with a plurality of pistons, and a cam shaft 15 configured to drive an inlet valve or an outlet valve in conjunction with the crankshaft 14. The engine 10 is also equipped with a crank angle sensor 14*a* and a cam angle sensor 15*a* configured to detect rotation angles of the crankshaft 14 and the cam shaft 15, respectively.

The ECU 100 acquires the rotation angles of the crankshaft 14 and the cam shaft 15 based on detection values of the crank angle sensor 14*a* and the cam angle sensor 15*a*. The cam shaft 15 is fixed to a later-described cam CP. The engine 10 is one example of the internal combustion engine.

The fuel tank 21 stores gasoline as a fuel. The low-pressure pump 22 pressurizes the fuel and discharges the fuel into the low-pressure pipe 25. The low-pressure pipe 25 is one example of the low-pressure passage configured to receive the fuel supplied from the low-pressure pump 22. The fuel pressurized up to a specified pressure level by the low-pressure pump 22 is supplied to the high-pressure pump 40 through the low-pressure pipe 25.

The high-pressure pump 40 is configured to pressurize the fuel supplied from the low-pressure pipe 25. The high-pressure pipe 35 receives the fuel supplied from the high-pressure pump 40. The high-pressure pump 40 will be described later in detail.

The delivery pipe 36 receives the high-pressure fuel pressurized by the high-pressure pump 40 supplied through the high-pressure pipe 35. The high-pressure pipe 35 and the delivery pipe 36 are examples of the high-pressure passage configured to receive the fuel supplied from the high-pressure pump 40.

The cylinder injection valve 17 is configured to receive the fuel supplied from the delivery pipe 36 to directly inject the fuel into a cylinder of the engine 10. The fuel pressure sensor 38 detects the fuel pressure in the delivery pipe 36. The ECU 100 acquires the detection value of the fuel pressure sensor 38.

The ECU 100 includes a central processing unit (CPU), a read only memory (ROM), and a random access memory (RAM). The ECU 100 executes later-described fuel pressure control based on information such as information from the sensors and information prestored in the ROM and in accordance with a control program prestored in the ROM. The control is implemented by a determination unit and a control unit that are functionally implemented by the CPU, the ROM, and the RAM. The details of the control will be described later.

A description is now given of the high-pressure pump 40. The high-pressure pump 40 includes a cylinder 41, a plunger 42, a compressing chamber 43, a suction passage 45, a discharge passage 47, a relief passage 49, a suction valve 50, a discharge valve 60, a relief valve 70, and drive mechanisms 80, 90.

The plunger 42 ascends and descends inside the cylinder 41 in conjunction with driving of the engine 10. More specifically, the plunger 42 is biased by a spring toward the cam CP that rotates with the cam shaft 15, and ascends and descends inside the cylinder 41 with rotation of the cam CP.

The compressing chamber 43 is defined by the cylinder 41 and the plunger 42. The capacity of the compressing chamber 43 decreases as the plunger 42 ascends, and the capacity of the compressing chamber 43 increases as the plunger 42 descends.

The suction passage 45 provides communication between the low-pressure pipe 25 and the compressing chamber 43. The discharge passage 47 provides communication between the compressing chamber 43 and the high-pressure pipe 35. The relief passage 49 has one end connected to the discharge passage 47 between the later-described discharge valve 60 and the high-pressure pipe 35, and has the other end connected to the compressing chamber 43.

Here, whether the plunger 42 is during a descending period or an ascending period is determined when the ECU 100 calculates a current rotation angle of the cam shaft 15 based on the detection value of the cam angle sensor 15*a*. Specifically, the determination is made based on a reference angle prestored in the ROM of the ECU 100 and on the current rotation angle of the cam shaft 15, the reference angle being an angle of the cam shaft 15 when the plunger 42 positions at a top dead center. Thus, the ECU 100 can determine the state of the high-pressure pump 40.

Here, since the cam CP in the present embodiment is in a substantially square shape with rounded corners, the plunger 42 positions at the top dead center four times while the cam shaft 15 turns 360 degrees. Therefore, when the angle of the cam shaft 15 when the plunger 42 positions at the top dead center is defined as a reference angle of zero degree, the plunger 42 positions at the top dead center when the cam shaft 15 is at 90 degrees, 180 degrees, and 270 degrees. The plunger 42 also positions at a bottom dead center when the cam shaft 15 is at 45 degrees, 135 degrees, 225 degrees, and 315 degrees. Therefore, the plunger 42 descends when the cam shaft 15 is in the range of zero degree to 45 degrees, 90 degrees to 135 degrees, 180 degrees to 225 degrees, and 270 degrees to 315 degrees. The plunger 42 ascends when the cam shaft 15 is in the range of 45 degrees to 90 degrees, 135 degrees to 180 degrees, 225 degrees to 270 degrees, and 315 degrees to 360 degrees (zero degree). Thus, whether or not the plunger 42 is ascending can be determined based on the angle of the cam shaft 15.

The shape of the cam CP is not limited to the substantially square shape with rounded corners, but may be a substantially equilateral triangle shape with rounded corners and an oval shape. In such a case, whether or not the plunger 42 is descending can be determined by the same technique as described above.

The determination of whether the plunger 42 is during the descending period or the ascending period may be made based on a detection value from the crank angle sensor 14*a* with the crank angle being associated with the position of the plunger 42, for example. The determination may also be made based on detection values of a sensor, which is provided to directly detect the positions of the plunger 42.

The suction valve 50, the discharge valve 60, and the relief valve 70 are provided in the suction passage 45, the discharge passage 47, and the relief passage 49, respectively.

The suction valve 50 is one example of the first check valve configured to permit communication of the fuel from the low-pressure pipe 25 side to the compressing chamber 43 side but to restrict communication in an opposite direction. The suction valve 50 includes a valve body 51, a valve seat portion 53, and a spring 55. The valve body 51 is one example of the first valve body. The valve seat portion 53 is one example of the first valve seat portion having a hole 53*a* formed therein, the valve seat portion 53 locating at a position closer to the low-pressure pipe 25 than to the valve body 51. The spring 55 is one example of the first biasing portion configured to bias the valve body 51 to the valve seat portion 53 so that the hole 53*a* is closed. The suction valve 50 will be described later in detail.

The discharge valve 60 is one example of the second check valve configured to permit communication of the fuel from the compressing chamber 43 side to the high-pressure pipe 35 side but to restrict communication in the opposite direction. The discharge valve 60 includes a valve body 61, a valve seat portion 63, and a spring 65. The valve body 61 is one example of the second valve body. The valve seat portion 63 is one example of the second valve seat portion having a hole 63*a* formed therein, the valve seat portion 63 locating at a position closer to the compressing chamber 43 than to the valve body 61. The spring 65 is one example of the second biasing portion configured to bias the valve body 61 to the valve seat portion 63 so that the hole 63*a* is closed. The discharge valve 60 will be described later in detail.

The relief valve 70 is configured to permit communication of the fuel from the discharge passage 47 side to the compressing chamber 43 side but to restrict communication of the fuel in the opposite direction. The relief valve 70 is opened when the fuel pressure in the high-pressure pipe 35 excessively increases, so that occurrence of abnormalities in the delivery pipe 36 or in the cylinder injection valve 17 is suppressed. The relief valve 70 includes a valve body 71, a valve seat portion 73, and a spring 75. The valve seat portion 73 has a hole 73*a* formed therein, the valve seat portion 73 being located at a position closer to the discharge passage 47 than the valve body 71. The spring 75 biases the valve body 71 to the valve seat portion 73 so that the hole 73*a* is closed.

Energization of the drive mechanism 80 and the drive mechanism 90 is controlled by the ECU 100. The drive mechanism 80 is one example of the first drive mechanism configured not to press the suction valve 50 in the energized state but to press and open the suction valve 50 in the non-energized state. The drive mechanism 90 is one example of the second drive mechanism configured not to press the discharge valve 60 in the non-energized state but to press and open the discharge valve 60 in the energized state. That is, the drive mechanism 80 opens the suction valve 50 in the non-energized state, while the drive mechanism 90 opens the discharge valve 60 in the energized state.

The drive mechanism 80 will be described in detail. The drive mechanism 80 includes a needle 81, a spring 83, a first coil 85, and a stopper 87. The needle 81 is one example of the first needle facing the valve body 51 through the hole 53*a*. The needle 81 has a front end extending up to the inside of the suction passage 45, the front end having a diameter sized to be insertable into the hole 53*a*. The spring 83 is one example of the first needle biasing portion provided between a base end of the needle 81 and the stopper 87, the spring 83 being configured to bias the needle 81 to the valve body 51. The stopper 87 is provided on the opposite side of the valve body 51 from the needle 81 to define a retractable position of the needle 81.

The first coil 85 is configured to be switched to the energized state or the non-energized state to drive the needle 81. Specifically, the first coil 85 retracts the needle 81 from the valve body 51 with magnetic attraction generated in the energized state against the biasing force of the spring 83. When the first coil 85 is in the non-energized state, the needle 81 presses the valve body 51 through the hole 53*a* so that the valve body 51 is separated from the valve seat portion 53 with the biasing force of the spring 83 to open the suction valve 50. Energization of the first coil 85 is switched by the ECU 100. Thus, energization of the drive mechanism 80 is controlled by switching energization of the first coil 85 in actuality.

Figure 2A:
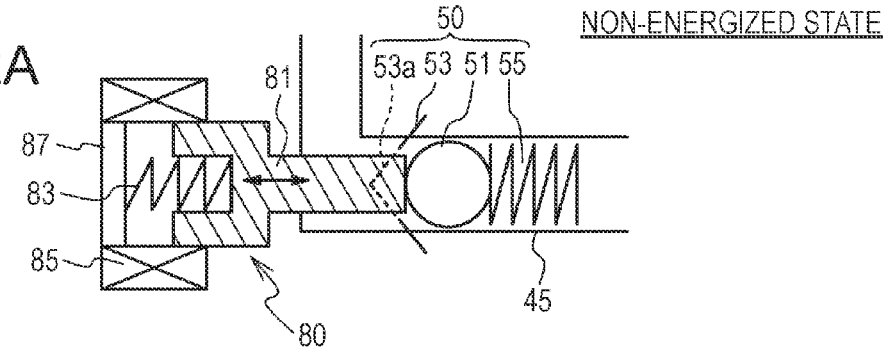
FIGS. 2A and 2B illustrate a first drive mechanism and a suction valve in a non-energized state and an energized state, respectively.
Figure 2B:
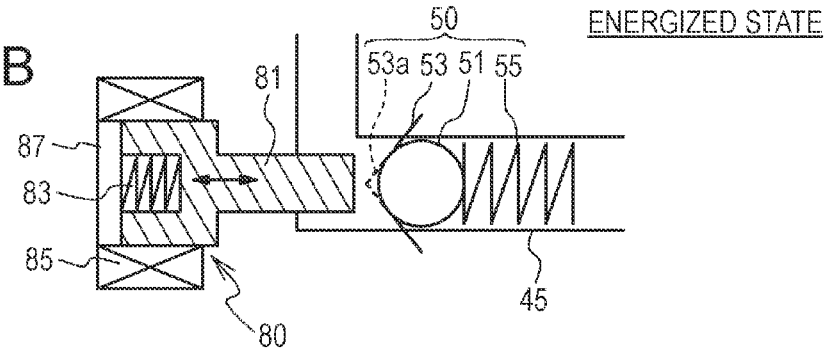

FIGS. 2A and 2B illustrate the drive mechanism 80 and the suction valve 50 in the non-energized state and the energized state, respectively. When the drive mechanism 80 is in the non-energized state, the suction valve 50 is forcibly maintained to be opened. When the drive mechanism 80 is put in energized state, the pressing force of the needle 81 toward the valve body 51 is canceled, and the suction valve 50 functions as a normal check valve. That is, when the fuel pressure on the low-pressure pipe 25 side is larger than the fuel pressure on the compressing chamber 43 side by a specified level or more, the valve body 51 is separated from the valve seat portion 53 against the biasing force of the spring 55, so that the hole 53*a* is opened. As a result, communication of the fuel from the low-pressure pipe 25 side to the compressing chamber 43 side is permitted.

The drive mechanism 90 will be described in detail. The drive mechanism 90 includes a needle 91, a spring 93, a second coil 95, and a stopper 97. The needle 91 is one example of the second needle facing the valve body 61 through the hole 63*a*. The needle 91 has a front end extending up to the inside of the discharge passage 47, the front end having a diameter sized to be insertable into the hole 63*a*. The needle 91 has a flange-like base end that is larger in diameter than the front end. The front end of the needle 91 penetrates the stopper 97 and defines an advanceable position of the needle 91. The spring 93 is one example of the second needle biasing portion configured to bias the needle 91 so that the needle 91 is separated from the valve body 61. The spring 93 is disposed between the stopper 97 and the base end of the needle 91.

The second coil 95 is one example of the second coil configured to be switched to the energized state or the non-energized state to drive the needle 91. Specifically, with the magnetic attraction generated in the energized state, the second coil 95 makes the needle 91 press the valve body 61 through the hole 63*a* so that the valve body 61 is separated from the valve seat portion 63 against the biasing force of the spring 93 to open the discharge valve 60. When the second coil 95 is in the non-energized state, the needle 91 retracts from the valve body 61 with the biasing force of the spring 93. Energization of the second coil 95 is switched by the ECU 100. Thus, energization of the drive mechanism 90 is controlled by switching energization of the second coil 95 in actuality.

Figure 2C:
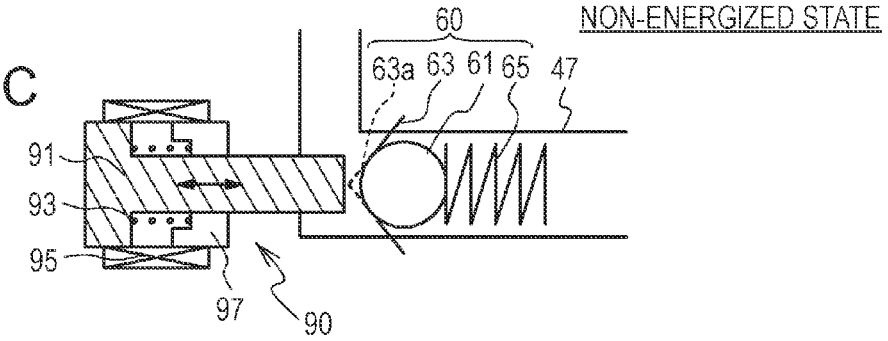
FIGS. 2C and 2D illustrate a second drive mechanism and a discharge valve in the non-energized state and the energized state, respectively.
Figure 2D:
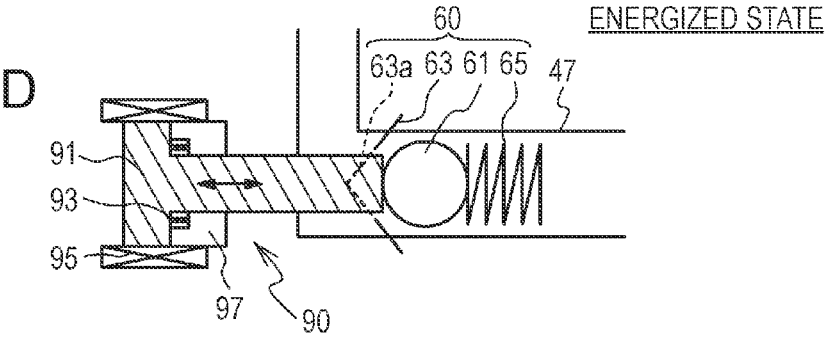

FIGS. 2C and 2D illustrate the drive mechanism 90 and the discharge valve 60 in the non-energized state and the energized state, respectively. When the drive mechanism 90 is in the non-energized state, the discharge valve 60 functions as a normal check valve. That is, when the fuel pressure on the compressing chamber 43 side is larger than the fuel pressure on the high-pressure pipe 35 side by a specified level or more, the valve body 61 is separated from the valve seat portion 63 against the biasing force of the spring 65, so that the hole 63*a* is opened. As a result, communication of the fuel from the compressing chamber 43 side to the high-pressure pipe 35 is permitted. When the drive mechanism 90 is put in the energized state, pressing force is applied to the valve body 61 from the needle 91, so that the discharge valve 60 is forcibly put in the opened state.

A description is now given of the fuel pressure control by the high-pressure pump 40. In the present embodiment, the fuel pressure control by the high-pressure pump 40 includes normal control and pressure reduction control. The normal control is the control performed on the high-pressure pump 40 so that the detection value of the fuel pressure sensor 38 that is a fuel pressure value in the delivery pipe 36 converges on a target fuel pressure value set in accordance with an operating state of the engine 10. Specifically, during execution of the normal control, energization of the drive mechanism 80 is switched while the drive mechanism 90 is maintained in the non-energized state.

The normal control will be described briefly. In the normal control, the ECU 100 constantly maintains the second coil 95 in the non-energized state as described before, while putting the first coil 85 in the energized state during an ascending period in which the plunger 42 ascends (hereinafter simply referred to as the ascending period) and putting the first coil 85 in the non-energized state during a descending period in which the plunger 42 descends (hereinafter simply referred to as the descending period).

When the first coil 85 is put in the non-energized state during the descending period, the fuel is sucked in from the low-pressure pipe 25 side to the compressing chamber 43 as illustrated in FIG. 2A. When the first coil 85 is put in the energized state during the ascending period, return of the fuel from the compressing chamber 43 to the low-pressure pipe 25 side is restricted as illustrated in FIG. 2B. Here, since the second coil 95 is constantly maintained in the non-energized state, the fuel is discharged from the compressing chamber 43 to the high-pressure pipe 35 side only when the fuel pressure is higher on the compressing chamber 43 side than on the high-pressure pipe 35 side by a specified value or more as illustrated in FIG. 2C.

Thus, the fuel pressure in the delivery pipe 36 can be maintained high. Furthermore, since the second coil 95 is constantly maintained in the non-energized state, the power consumption of the second coil 95 is zero under the normal control. A discharge amount of the fuel from the compressing chamber 43 to the high-pressure pipe 35 side can be changed by controlling a period in which the first coil 85 is energized during the ascending period.

A description is now given of the pressure reduction control. The pressure reduction control is the control on the high-pressure pump 40 to rapidly lower the fuel pressure in the delivery pipe 36, when a pressure reduction request arises when a certain condition is satisfied. Specifically, during execution of the pressure reduction control, energization of the drive mechanism 80 and the driving unit 90 is switched. Here, the condition under which the pressure reduction request arises is execution of a fuel cut. If the fuel pressure in the delivery pipe 36 is rapidly lowered during execution of the fuel cut, it becomes possible to prevent the fuel pressure in the delivery pipe 36 from becoming larger than a target fuel pressure value and to thereby prevent excessive increase in the fuel injection amount of the cylinder injection valve 17 at the time of cancelling the fuel cut. When a fuel cut cancel request arises, the pressure reduction request disappears and the normal control is executed.

When the pressure reduction request does not arise, the target fuel pressure value may be set lower than the detection value of the fuel pressure sensor 38. In this case, under the normal control described before, energization of the drive mechanism 80 is switched so that a suction amount of the fuel from the low-pressure pipe 25 side to the compressing chamber 43 is regulated to be smaller than the fuel consumption in the cylinder injection valve 17. That is, when there is a request for rapid decrease in fuel pressure in the delivery pipe 36, which cannot be met only by switching energization of the drive mechanism 80 under such normal control, the pressure reduction control is executed.

The condition under which the pressure reduction request arises is not limited to execution of the fuel cut, but may be satisfaction of any condition indicating necessity of a rapid decrease in fuel pressure in the delivery pipe 36. For example, the pressure reduction request may arise when the detection value of the fuel pressure sensor 38 exceeds an upper limit that is preset in order to prevent fuel leakage from the cylinder injection valve 17. In this case, when the detection value of the fuel pressure sensor 38 reaches the upper limit or less, the pressure reduction request is canceled. The pressure reduction request may also arise when the detection value of the fuel pressure sensor 38 exceeds a preset threshold, the target fuel pressure value is smaller than the detection value of the fuel pressure sensor 38, and a difference between the target fuel pressure value and the detection value of the fuel pressure sensor 38 exceeds a specified value. In this case, the pressure reduction request is canceled when the detection value of the fuel pressure sensor 38 becomes equal to or below the threshold, or when the difference between the target fuel pressure value and the detection value of the fuel pressure sensor 38 becomes equal to or below the specified value. The pressure reduction request may also arise when the detection value of the fuel pressure sensor 38 exceeds a reference value at which rapid decrease in fuel pressure in the delivery pipe 36 cannot be achieved only by opening of the relief valve 70. Also in this case, once the detection value of the fuel pressure sensor 38 becomes equal to or below the reference value, the pressure reduction request is canceled.

Figure 3:
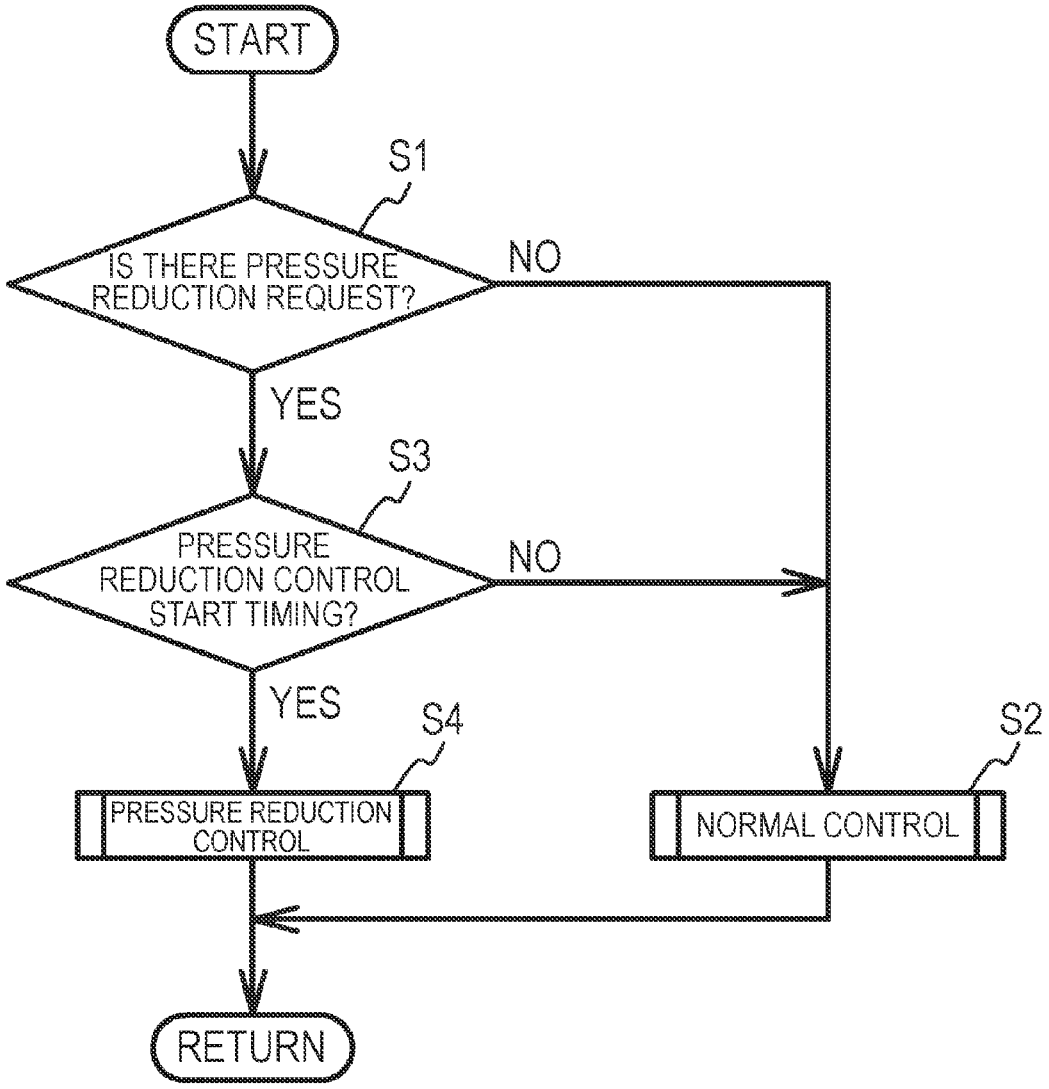
FIG. 3 is a flowchart illustrating one example of fuel pressure control executed by an ECU.

A description is now given of one example of the fuel pressure control executed by the ECU 100. FIG. 3 is a flowchart illustrating one example of the fuel pressure control executed by the ECU 100. The ECU 100 repeatedly executes the fuel pressure control at every predetermined time.

The ECU 100 first determines whether or not there is a pressure reduction request (step S1). When there is no pressure reduction request, the ECU 100 executes the normal control (step S2). When there is a pressure reduction request, the ECU 100 determines whether or not pressure reduction control start timing is matured (step S3). When the determination result is negative, the normal control is executed (step S2), whereas when the determination result is positive, the pressure reduction control is executed (step S4).

That is, when there is a pressure reduction request during execution of the normal control but the pressure reduction control start timing is not matured yet, the normal control is executed. The pressure reduction control start timing is the timing at which the plunger 42 positions at the top dead center in the present embodiment. The detail of the pressure reduction control start timing will be described later in detail.

Figure 4:
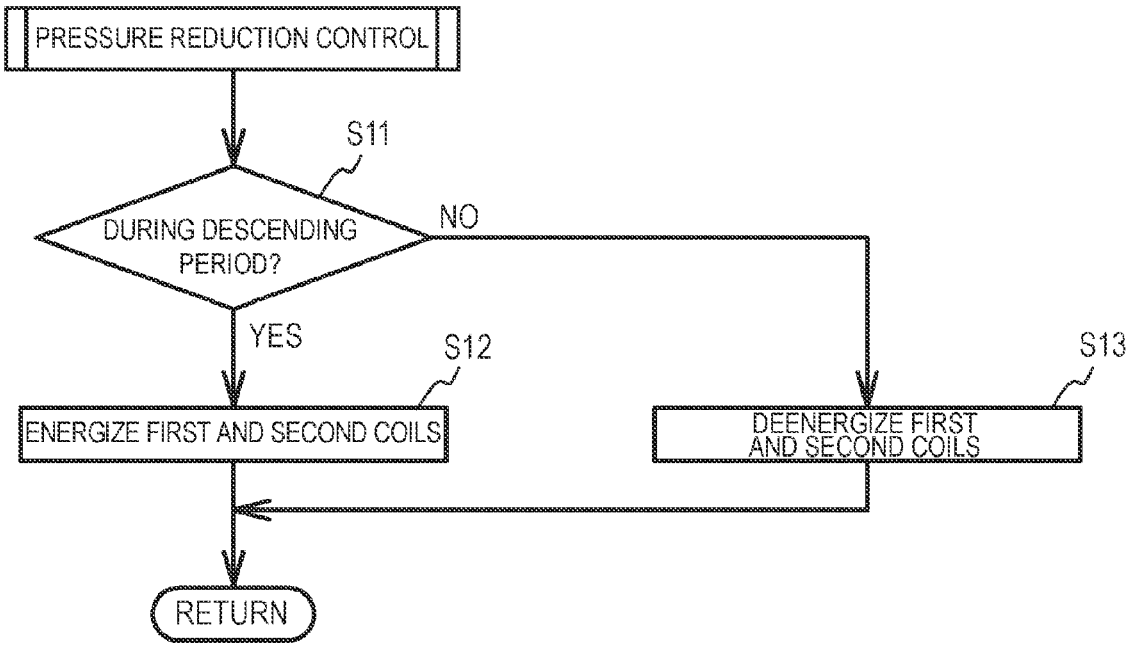
FIG. 4 is a flowchart illustrating one example of pressure reduction control executed by the ECU.
Figure 5:
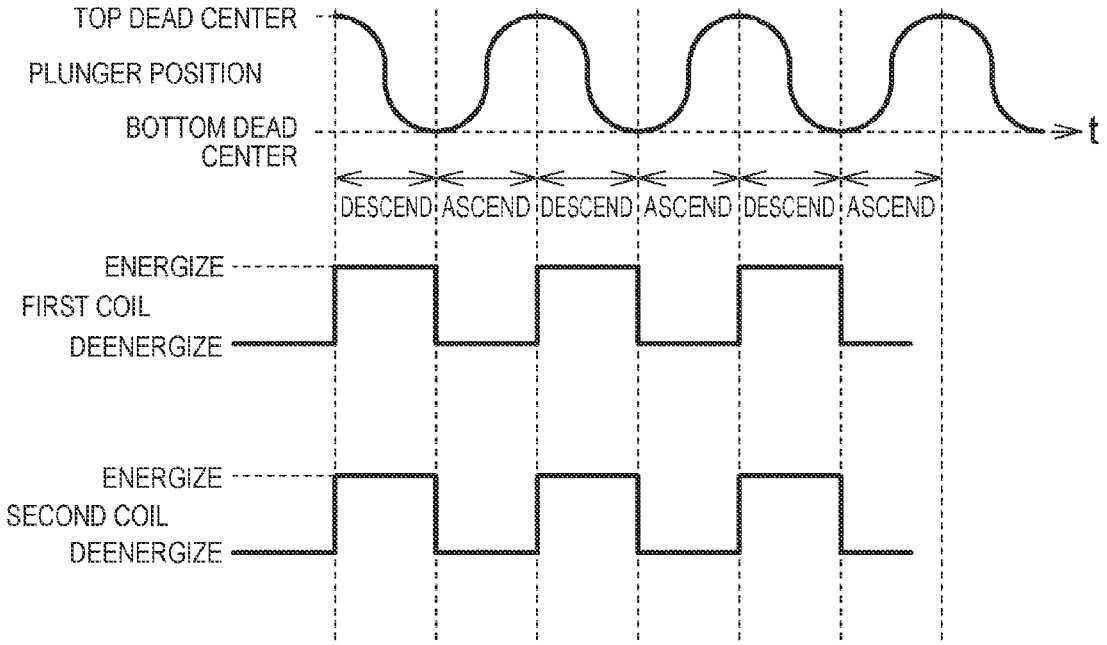
FIG. 5 is a timing chart of the pressure reduction control.

A detailed description is now given of the pressure reduction control. FIG. 4 is a flowchart illustrating one example of the pressure reduction control executed by the ECU 100. The ECU 100 repeatedly executes the pressure reduction control at every predetermined time. FIG. 5 is a timing chart of the pressure reduction control. In FIG. 5, the position of the plunger 42, and energization switching statuses of the first coil 85 and the second coil 95 are depicted.

The ECU 100 determines, based on the rotation angle of the cam shaft 15, whether or not it is during the descending period (step S11). The processing of step S11 is one example of the processing executed by the determination unit to determine whether it is during the descending period of the plunger 42 descending or during the ascending period of the plunger 42 ascending.

When the determination result is positive in step S11, the ECU 100 puts the first coil 85 and the second coil 95 in the energized state (step S12). As described in the foregoing, when the first coil 85 and the second coil 95 are put in the energized state, the suction valve 50 functions as a normal check valve, and the discharge valve 60 is opened.

Here, when the first coil 85 and the second coil 95 are put in the energized state during the descending period, the fuel returns from the high-pressure pipe 35 side to the compressing chamber 43 through the opened discharge valve 60 since the capacity of the compressing chamber 43 increases during descending period. Accordingly, the fuel pressure becomes higher on the compressing chamber 43 side of the suction valve 50 than on the low-pressure pipe 25 side, so that the suction valve 50 is maintained closed. This makes it possible to suppress suction of the fuel from the low-pressure pipe 25 side to the compressing chamber 43 and to return the fuel from the high-pressure pipe 35 side to the compressing chamber 43 during the descending period. As a consequence, the fuel pressure in the delivery pipe 36 can be lowered.

When the determination result is negative in step S11, i.e., in the case of during the ascending period, the ECU 100 puts the first coil 85 and the second coil 95 in the non-energized state (step S13). As described in the foregoing, when the first coil 85 and the second coil 95 are put in the non-energized state, the suction valve 50 is opened, and the discharge valve 60 functions as a normal check valve.

Here, when the first coil 85 and the second coil 95 are put in the non-energized state during the ascending period, the fuel returns from the compressing chamber 43 to the low-pressure pipe 25 side through the suction valve 50 since the capacity of the compressing chamber 43 decreases during the ascending period. Accordingly, the fuel pressure becomes lower on the compressing chamber 43 side of the discharge valve 60 than on the high-pressure pipe 35 side, so that the discharge valve 60 is maintained closed. Therefore, discharge of the fuel from the compressing chamber 43 to the high-pressure pipe 35 is suppressed during the ascending period. As a consequence, increase in fuel pressure in the delivery pipe 36 is suppressed.

As described in the foregoing, the fuel pressure in the delivery pipe 36 can rapidly be lowered using ascending and descending of the plunger 42. The processing of steps S12, S13 is one example of the processing executed by the control unit to put the drive mechanisms 80, 90 in the energized state during the descending period, and in the non-energized state during the ascending period, when there is a pressure reduction request. Once the processing of step S12 or S13 is executed, the processing subsequent to step S11 is executed again.

The pressure reduction control start timing in step S3 is the timing at which the plunger 42 positions at the top dead center, but is not limited thereto. For example, the timing may be the timing at which the plunger 42 positions at any other timing within the ascending period.

For example, when the pressure reduction control start timing is set within the descending period, a following problem may arise. During the descending period, the capacity of the compressing chamber 43 increases and the fuel pressure on the compressing chamber 43 side of the discharge valve 60 becomes lower than the high-pressure pipe 35 side. Accordingly, when energization of the second coil 95 is started during the descending period, the needle 91 needs to press the valve body 61 so that the valve body 61 is separated from the valve seat portion 63 against the high fuel pressure applied to the valve body 61 from the high-pressure pipe 35 side. As a result, the needle 91 needs large force to move the valve body 61, which may increase power consumption of the second coil 95 and may deteriorate power efficiency due to heat generation in the second coil 95.

As compared with the above case, the pressure reduction control start timing in the present embodiment is set to a time point that is not within the descending period. Therefore, the power consumption of the second coil 95 is suppressed in the present embodiment.

Figure 6:
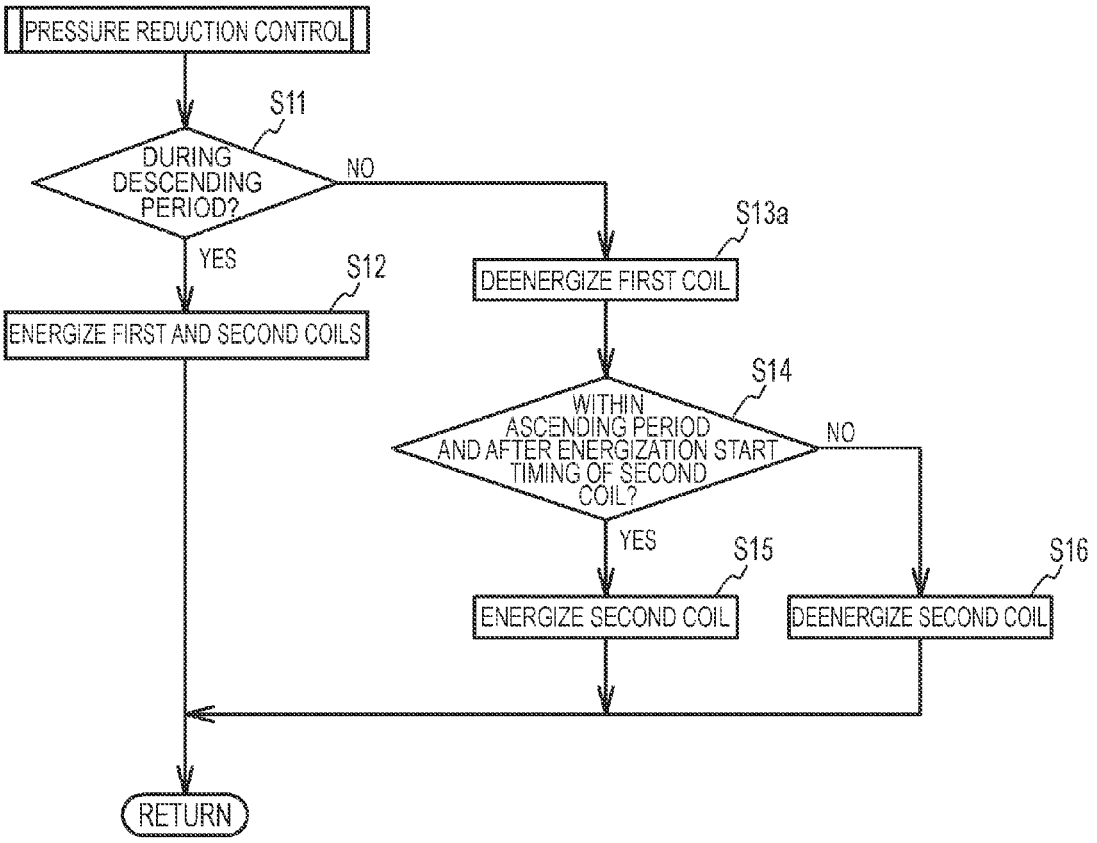
FIG. 6 is a flowchart of a first modification of the pressure reduction control executed by the ECU.
Figure 7:
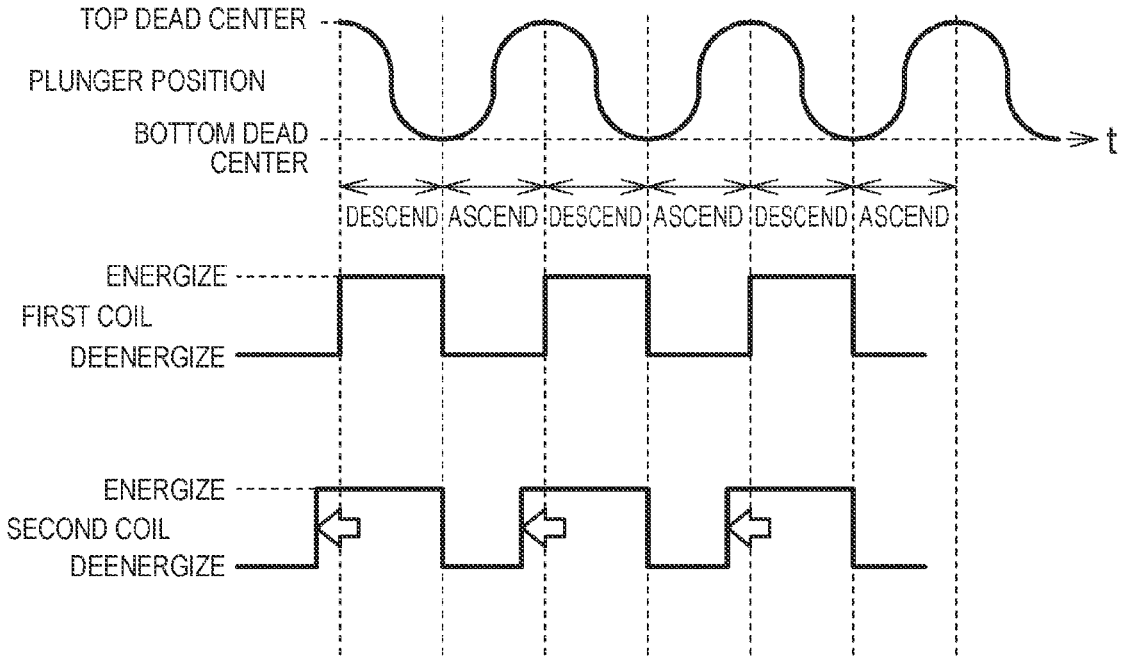
FIG. 7 is a timing chart of the first modification of the pressure reduction control.

A description is now given of a first modification of the pressure reduction control. FIG. 6 is a flowchart of the first modification of the pressure reduction control executed by the ECU 100. FIG. 7 is a timing chart of the first modification of the pressure reduction control.

The ECU 100 determines whether or not it is during the descending period (step S11). When the determination result is positive, the first coil 85 and the second coil 95 are put in the energized state as in the disclosed embodiment (step S12).

When the determination result is negative in step S11, the ECU 100 puts the first coil 85 in the non-energized state (step S13*a*), and determines whether or not it is within a latter half period of the ascending period and after the energization start timing of the second coil 95 (step S14). When the determination result is positive in step S14, the ECU 100 puts the second coil 95 in the energized state (step S15), whereas when the determination result is negative, the ECU 100 puts the second coil 95 in the non-energized state (step S16).

The energization start timing of the second coil 95, which is the timing preset within the latter half period of the ascending period, is stored in the ROM of the ECU 100 in association with the angle of the cam shaft 15. Therefore, the second coil 95 starts to be energized within the latter half period of the ascending period, and the energized state is continued even during the descending period. Once the processing of step S15 or S16 is executed, the processing subsequent to step S11 is executed again.

A description is given of the reason why the energization start timing of the second coil 95 is set within the latter half period of the ascending period in the first modification. During the ascending period, the capacity of the compressing chamber 43 reduces, and part of the fuel in the compressing chamber 43 flows to the discharge valve 60 side, so that the fuel pressure on the compressing chamber 43 side of the discharge valve 60 increases. Accordingly, if the second coil 95 starts to be energized while the fuel pressure on the compressing chamber 43 side of the valve body 61 increases, the fuel pressure on the compressing chamber 43 side of the valve body 61 and the pressing force from the needle 91 act upon the valve body 61, which makes it possible to easily separate the valve body 61 from the valve seat portion 63. This makes it possible to open the discharge valve 60 while suppressing the power consumption of the second coil 95.

In the first modification, the energization start timing of the second coil 95 may be any timing as long as it is within the latter half period of the ascending period. However, even within the latter half period of the ascending period, the discharge amount of the fuel to the high-pressure pipe 35 side through the discharge valve 60 during the ascending period becomes larger as the energization start timing of the second coil 95 is closer to the middle of the ascending period. Accordingly, the speed of pressure reduction in the delivery pipe 36 may become slow. It is necessary, therefore, to set the energization start timing of the second coil 95 after decrease in the pressure reduction speed and suppression in power consumption are compared and taken into consideration.

Although the pressure reduction control start timing in step S3 is set to the energization start timing of the second coil 95 in the first modification, the timing is not limited thereto. For example, the timing may be the timing at which the plunger 42 positions at the bottom dead center and any timing within the ascending period except a period after the energization start timing of the second coil 95.

Figure 8:
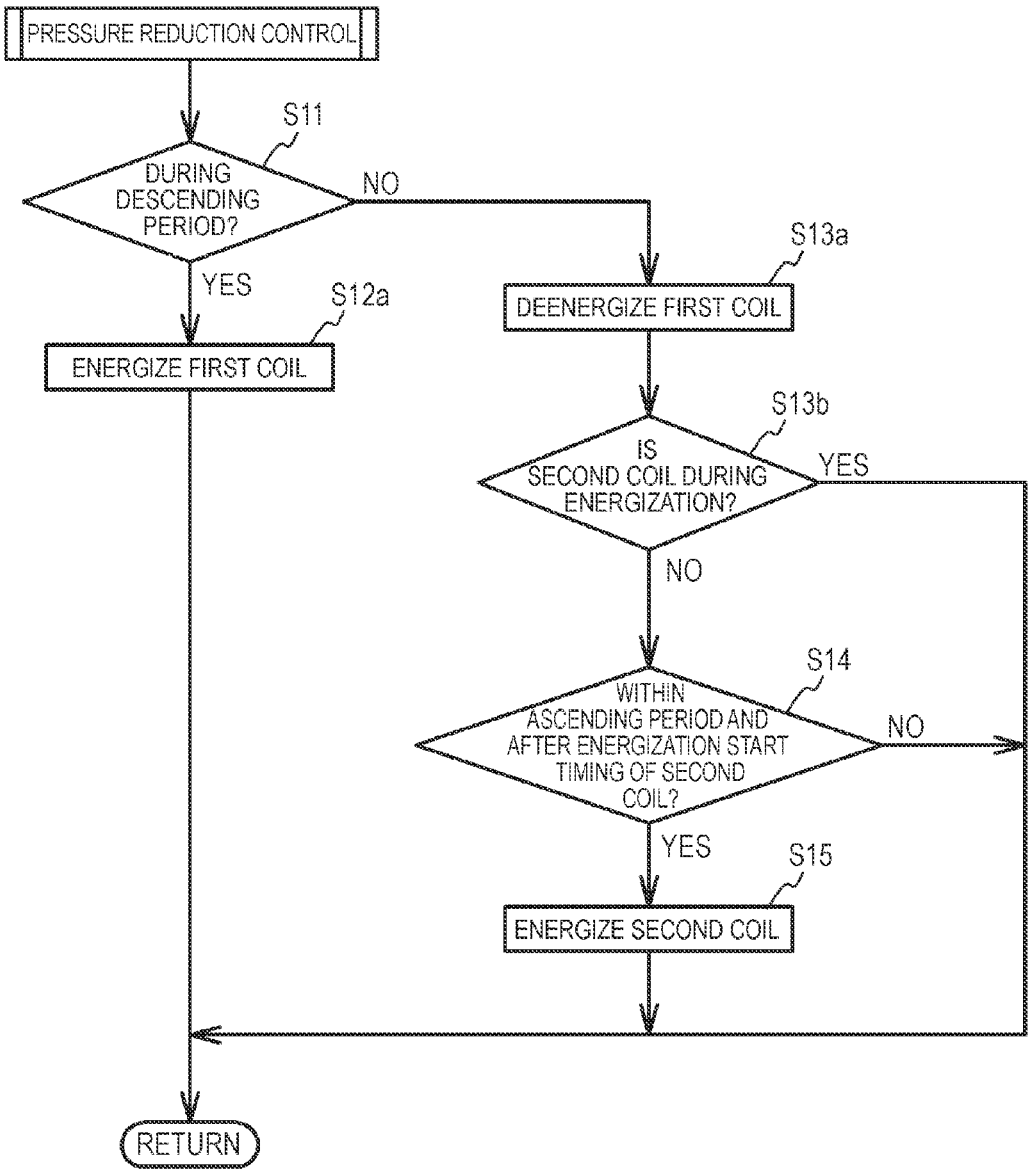
FIG. 8 is a flowchart illustrating a second modification of the pressure reduction control executed by the ECU.
Figure 9:
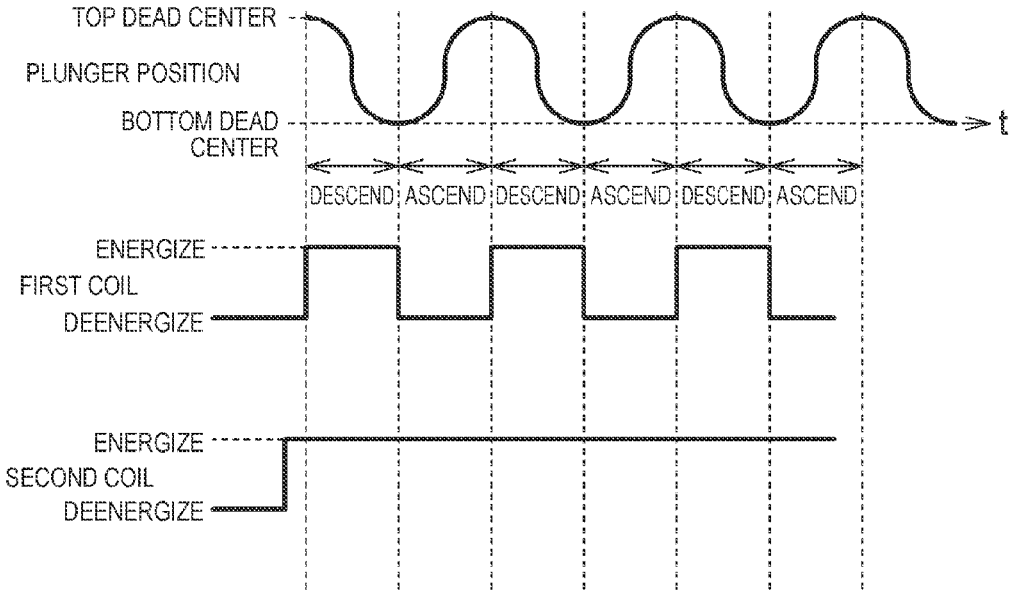
FIG. 9 is a timing chart of the second modification of the pressure reduction control.

A description is now given of a second modification of the pressure reduction control. FIG. 8 is a flowchart illustrating the second modification of the pressure reduction control executed by the ECU 100. FIG. 9 is a timing chart of the second modification of the pressure reduction control.

The ECU 100 determines whether or not it is during the descending period (step S11). When the determination result is positive, the first coil 85 is put in the energized state (step S12*a*), whereas when the determination result is negative, the first coil 85 is put in the non-energized state (step S13*a*).

After execution of the processing of step S13*a*, the ECU 100 determines whether or not the second coil 95 is during energization (step S13*b*). When the determination result is negative in step S13*b*, the ECU 100 determines whether or not it is within the latter half period of the ascending period and after the energization start timing of the second coil 95 (step S14). When the determination result is negative, the ECU 100 executes processing subsequent to step S11 again, whereas when the determination result is positive, the ECU 100 puts the second coil 95 in the energized state (step S15). Once the processing of step S15 is executed, the processing subsequent to step S11 is executed again. Accordingly, once the second coil 95 is put in the energized state in the processing of step S15, positive determination is made in step S13*b*, and the second coil 95 is maintained in the energized state regardless of whether it is during the descending period or the ascending period.

The processing of steps S12*a*, S13*a*, S13*b*, S15 is one example of the processing executed by the control unit when there is a pressure reduction request. In the processing, the drive mechanism 80 is put in the energized state during the descending period and in the non-energized state during the ascending period, and the drive mechanism 90 is maintained in the energized state during both the descending period and the ascending period.

With the first coil 85 being put in the energized state during the descending period and in the non-energized state during the ascending period as described before, suction of the fuel from the low-pressure pipe 25 side to the compressing chamber 43 is suppressed during the descending period, and the fuel can be returned to the low-pressure pipe 25 side from the compressing chamber 43 during the ascending period. With the second coil 95 being maintained in the energized state during both the descending period and the ascending period, the discharge valve 60 is constantly kept opened, so that the fuel can be returned to the compressing chamber 43 from the high-pressure pipe 35 side. As a consequence, the fuel pressure in the delivery pipe 36 can rapidly be lowered.

Also in the second modification, increase in power consumption of the second coil 95 while the discharge valve 60 is opened is suppressed by the processing of steps S14, S15.

Although the pressure reduction control start timing in step S3 is set to the energization start timing of the second coil 95 in second modification, the timing is not limited thereto. For example, the timing may be the timing when the plunger 42 positions at the bottom dead center or any other timing within the ascending period except a period after the energization start timing of the second coil 95.

Figure 10:
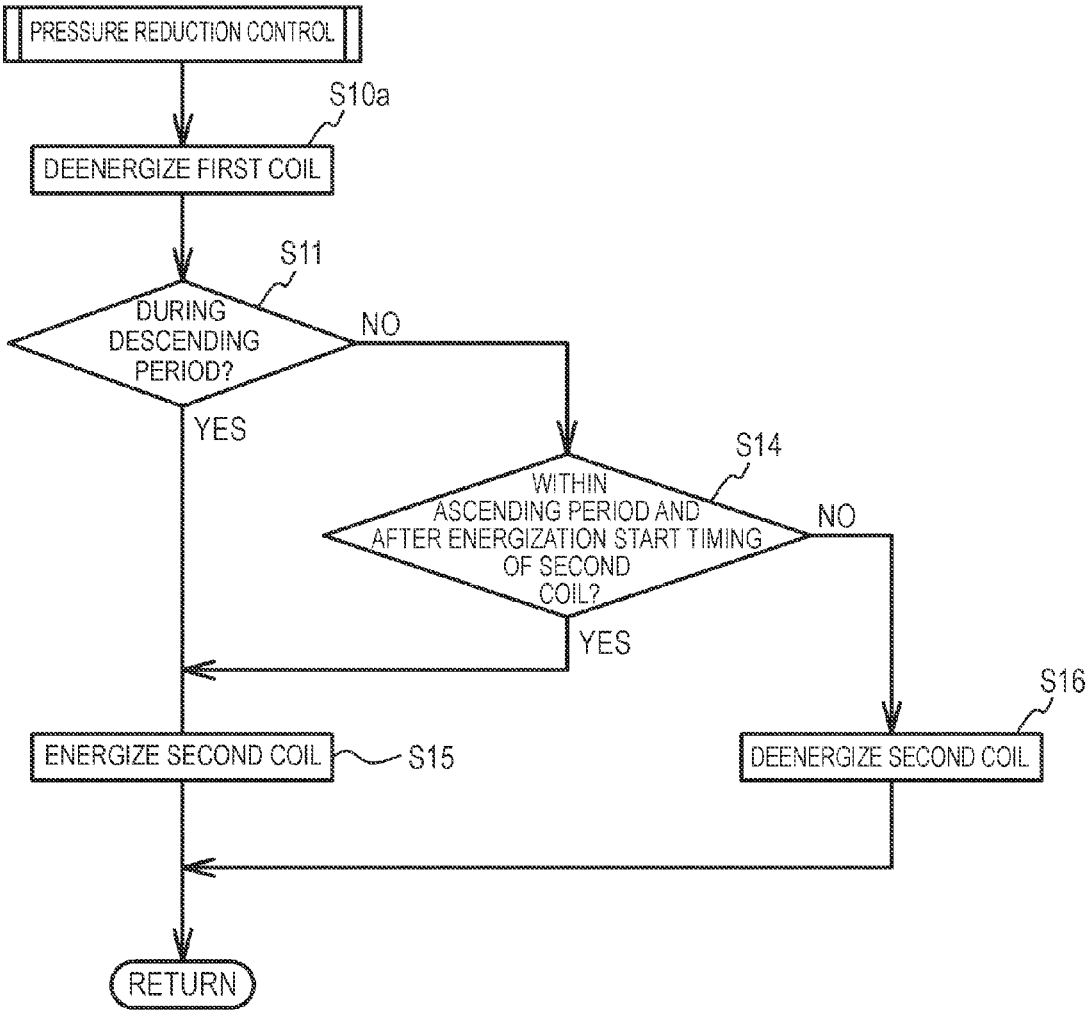
FIG. 10 is a flowchart illustrating a third modification of the pressure reduction control executed by the ECU.
Figure 11:
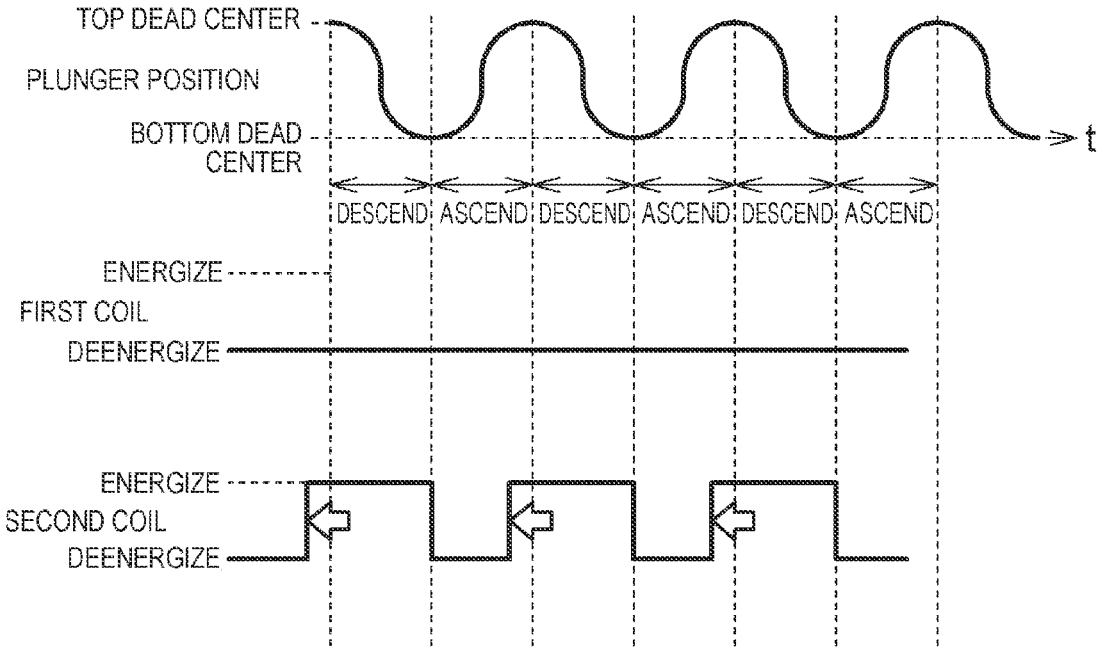
FIG. 11 is a timing chart of the third modification of the pressure reduction control.

A description is now given of a third modification of the pressure reduction control. FIG. 10 is a flowchart illustrating a third modification of the pressure reduction control executed by the ECU 100. FIG. 11 is a timing chart of the third modification of the pressure reduction control.

The ECU 100 puts the first coil 85 in the non-energized state during both the ascending period and the descending period (step S10*a*). Accordingly, the first coil 85 is constantly maintained in the non-energized state regardless of whether it is during the ascending period or the descending period. Next, the ECU 100 determines whether or not it is during the descending period (step S11). When the determination result is positive, the second coil 95 is energized (step S15). When the determination result is negative, the ECU 100 determines whether or not it is within the latter half period of the ascending period and after the energization start timing of the second coil 95 (step S14). When the determination result is positive, the ECU 100 puts the second coil 95 in the energized state (S15), whereas when the determination result is negative, the ECU 100 puts the second coil 95 in the non-energized state (step S16).

The processing of steps S10*a*, S15, S16 is one example of the processing executed by the control unit when there is a pressure reduction request. In the processing, the drive mechanism 80 is maintained in the non-energized state during both the descending period and ascending period, while the drive mechanism 90 is put in the energized state during the descending period and in non-energized state during the ascending period.

With the second coil 95 being put in the energized state during the descending period and in the non-energized state during the ascending period, the fuel returns from the high-pressure pipe 35 side to the compressing chamber 43 during the descending period, and discharge of the fuel to the high-pressure pipe 35 side is suppressed during the ascending period.

Since the second coil 95 starts to be energized after a specified period in the latter half period of the ascending period, the discharge valve 60 can be opened while the power consumption of the second coil 95 is suppressed.

With the first coil 85 being maintained in the non-energized state during both the descending period and the ascending period, the first suction valve 50 is constantly be opened. As a result, the fuel can be returned from the compressing chamber 43 to the low-pressure pipe 25 side during the ascending period, while power consumption by the first coil 85 can be lowered.

Also in the third modification, the pressure reduction control start timing in step S3 is set to the energization start timing of the second coil 95, but the timing is not limited thereto. For example, the timing may be the timing when the plunger 42 positions at the bottom dead center or any other timing within the ascending period except a period after the energization start timing of the second coil 95.

In the third modification, the energization start timing of the second coil 95 may be at a time point when the plunger 42 is at the top dead center.

Figure 12:
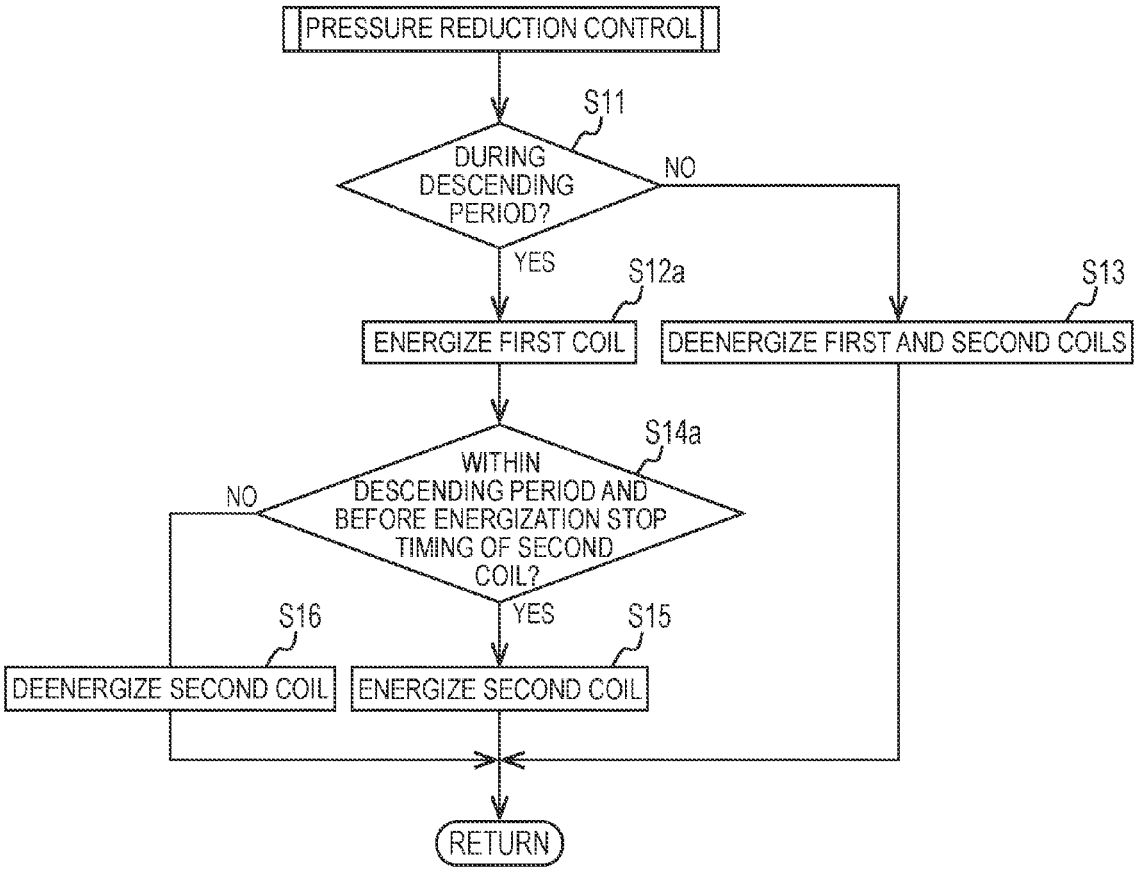
FIG. 12 is a flowchart illustrating a fourth modification of the pressure reduction control executed by the ECU.
Figure 13:
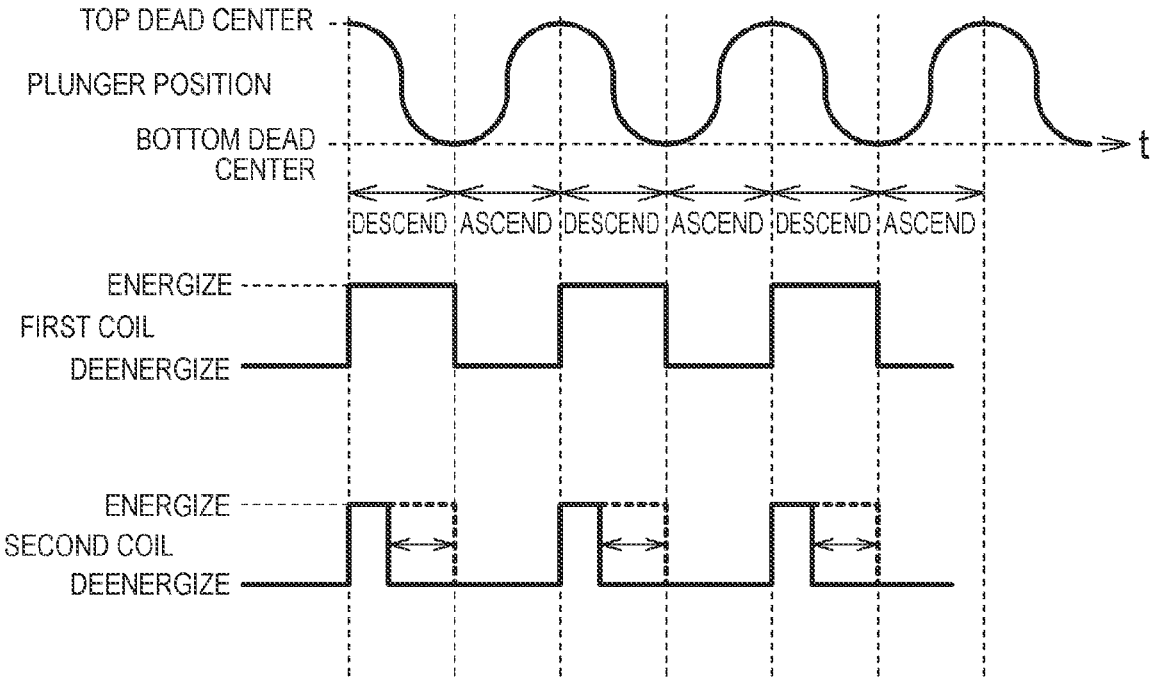
FIG. 13 is a timing chart of the fourth modification of the pressure reduction control.

FIG. 12 is a flowchart illustrating a fourth modification of the pressure reduction control. FIG. 13 is a timing chart of the fourth modification of the pressure reduction control.

The ECU 100 determines whether or not it is during the descending period (step S11). When the determination result is negative, the first coil 85 and the second coil 95 are put in the non-energized state (step S13). When the determination result is positive in step S11, the ECU 100 puts the first coil 85 in the energized state (step S12*a*), and determines whether or not it is after energization stop timing of the second coil 95 within the descending period (step S14*a*). When the determination result is positive in step S14*a*, the ECU 100 puts the second coil 95 in the energized state (step S15), whereas when the determination result is negative, the ECU 100 puts the second coil 95 in the non-energized state (step S16).

The energization stop timing of the second coil 95, which is the timing preset within the descending period, is stored in the ROM of the ECU 100 in association with the angle of the cam shaft 15. Accordingly, the energization stop timing of the second coil 95 in the fourth modification is moved up from the timing in the embodiment illustrated in FIG. 5. Therefore, the second coil 95 stops to be energized within the descending period, and the non-energized state is continued even during the ascending period. Accordingly, in the fourth modification, the energization period of the second coil 95 is shorter than that in the disclosed embodiment, so that power consumption is suppressed.

The energization period of the second coil 95 may be shortened not by moving up the energization stop timing of the second coil 95 but by delaying the energization start timing of the second coil 95 to be set within the descending period. However, as described in the foregoing, the capacity of the compressing chamber 43 increases during the descending period, so that the fuel pressure on the compressing chamber 43 side of the discharge valve 60 becomes lower than the high-pressure pipe 35 side. Accordingly, when the second coil 95 starts to be energized during the descending period, the needle 91 needs to press the valve body 61 so that the valve body 61 is separated from the valve seat portion 63 against the high fuel pressure applied to the valve body 61 from the high-pressure pipe 35 side. As a result, the needle 91 needs large force to move the valve body 61, which may increase power consumption of the second coil 95. Therefore, in the fourth modification, the power consumption of the second coil 95 is suppressed not by delaying the energization start timing of the second coil 95 but by moving up the energization stop timing of the second coil 95.

In the fourth modification, the energization stop timing of the second coil 95 may be any timing as long as it is within the descending period. However, even within the descending period, the amount of the fuel returning from the high-pressure pipe 35 to the compressing chamber 43 side through the discharge valve 60 during the descending period is smaller as the energization stop timing of the second coil 95 is closer to start timing of the descending period. Accordingly, the speed of pressure reduction in the delivery pipe 36 may be slowed. It is necessary, therefore, to set the energization stop timing of the second coil 95 after decrease in the pressure reduction speed and suppression in power consumption are compared and taken into consideration.

Also in the fourth modification, the energization start timing of the second coil 95 may be set within the latter half period of the ascending period, or the first coil 85 may constantly be put in the non-energized state.

Although the embodiment has been described in detail, an invention is not limited to such a specific embodiment, and various modifications and changes may be made without departing from the scope of the invention disclosed in the range of the claims.

In the embodiment, and the first, second, and fourth modifications, the first coil 85 is maintained in the energized state over the entire period during the descending period. However, the first coil 85 may be put in the energized state at least during the descending period. This is because the suction amount of the fuel from the low-pressure pipe 25 side to the compressing chamber 43 in the descending period can be suppressed. During the ascending period, it is desirable for the first coil 85 to be in the non-energized state over the entire ascending period. This is because the amount of the fuel returning from the compressing chamber 43 to the low-pressure pipe 25 side can be increased.

What is claimed is:

1. A fuel pressure control device comprising:

a low-pressure pump configured to suck fuel in a fuel tank;

a low-pressure passage configured to receive the fuel supplied from the low-pressure pump;

a high-pressure pump configured to pressurize the fuel supplied from the low-pressure passage;

a high-pressure passage configured to receive the fuel supplied from the high-pressure pump;

a cylinder injection valve configured to receive the fuel supplied from the high-pressure passage to directly inject the fuel into a cylinder of an internal combustion engine, the high-pressure pump including a cylinder, a plunger configured to ascend and descend inside the cylinder in conjunction with driving of the internal combustion engine, a compressing chamber having a capacity decreased by the plunger ascending and increased by the plunger descending, a suction passage configured to provide communication between the low-pressure passage and the compressing chamber;

a discharge passage configured to provide communication between the compressing chamber and the high-pressure passage, a first control valve provided in the suction passage, the first control valve being configured to permit or prohibit communication of the fuel between the low-pressure passage and the compressing chamber, a second control valve provided in the discharge passage, the second control valve being configured to permit communication of the fuel from the compressing chamber to the high-pressure passage, and the second control valve being configured to restrict communication of the fuel from the high-pressure passage to the compressing chamber, a first drive mechanism configured to open or close the first control valve by energization control, and a second drive mechanism configured to open or close the second control valve by energization control; and an electronic control unit configured to i) determine whether the plunger is in a descending period during which the plunger is descending or the plunger is in an ascending period during which the plunger is ascending, ii) cause the first control valve to be closed and the second control valve to be open by using the first drive mechanism and the second drive mechanism during the descending period when there is a pressure reduction request to lower a fuel pressure inside the high-pressure passage, and iii) cause the first control valve to be open and the second control valve to be closed by using the first drive mechanism and the second drive mechanism during the ascending period when there is the pressure reduction request.

2. The fuel pressure control device according to claim 1, wherein the electronic control unit is configured to start energization of the second drive mechanism within a latter half period of the ascending period, and the electronic control unit is configured to put the second drive mechanism in the energized state during the descending period.

3. The fuel pressure control device according to claim 1, wherein the electronic control unit is configured to stop energization of the second drive mechanism during the descending period, the electronic control unit is configured to put the second drive mechanism in the non-energized state during the ascending period.

4. The fuel pressure control device according to claim 1, wherein the first control valve includes a first valve body, a first valve seat portion having a first hole, the first valve seat portion being located at a position closer to the low-pressure passage than to the first valve body, a first biasing portion configured to bias the first valve body to the first valve seat portion so as to close the first hole, the first drive mechanism includes a first needle facing the first valve body through the first hole, a first needle biasing portion configured to bias the first needle to the first valve body, and a first coil configured to be switched to the energized state or the non-energized state to drive the first needle, and the first needle is configured such that the first needle is separated from the first valve body with magnetic force generated by the first coil in the energized state against biasing force of the first needle biasing portion and that the first needle presses the first valve body through the first hole such that the first valve body is separated from the first valve seat portion with the biasing force of the first needle biasing portion with the first coil in the non-energized state.

5. The fuel pressure control device according to claim 1, wherein the second control valve includes a second valve body, a second valve seat portion having a second hole, the second valve seat portion being located at a position closer to the compressing chamber than to the second valve body, and a second biasing portion configured to bias the second valve body to the second valve seat portion so as to close the second hole, the second drive mechanism includes a second needle facing the second valve body through the second hole, a second needle biasing portion configured to bias the second needle such that the second needle is separated from the second valve body, and a second coil configured to be switched to the energized state or the non-energized state to drive the second needle, and the second needle is configured such that the second needle presses the second valve body through the second hole such that the second valve body is separated from the second valve seat portion with magnetic force generated by the second coil in the energized state against the biasing force of the second needle biasing portion and that the second needle is separated from the second valve body with the biasing force of the second needle biasing portion with the second coil in the non-energized state.

6. A fuel pressure control device comprising:

a low-pressure pump configured to suck fuel in a fuel tank;

a low-pressure passage configured to receive the fuel supplied from the low-pressure pump;

a high-pressure pump configured to pressurize the fuel supplied from the low-pressure passage;

a high-pressure passage configured to receive the fuel supplied from the high-pressure pump;

a cylinder injection valve configured to receive the fuel supplied from the high-pressure passage to directly inject the fuel into a cylinder of an internal combustion engine, the high-pressure pump including a cylinder, a plunger configured to ascend and descend inside the cylinder in conjunction with driving of the internal combustion engine, a compressing chamber having a capacity decreased by the plunger ascending and increased by the plunger descending, a suction passage configured to provide communication between the low-pressure passage and the compressing chamber, a discharge passage configured to provide communication between the compressing chamber and the high-pressure passage, a first control valve provided in the suction passage, the first control valve being configured to permit or prohibit communication of the fuel between the low-pressure passage and the compressing chamber, a second control valve provided in the discharge passage, the second control valve being configured to permit communication of the fuel from the compressing chamber to the high-pressure passage and the second control valve being configured to restrict communication of the fuel from the high-pressure passage to the compressing chamber, a first drive mechanism configured not to press the first control valve in an energized state but to press and open the first control valve in a non-energized state, and a second drive mechanism configured not to press the second control valve in the non-energized state but to press and open the second control valve in the energized state; and an electronic control unit configured to i) determine whether the plunger is in a descending period during which the plunger is descending or the plunger is in an ascending period during which the plunger is ascending, ii) maintain the first drive mechanism in the non-energized state during both the descending period and the ascending period when there is a pressure reduction request to lower a fuel pressure inside the high-pressure passage, iii) put the second drive mechanism in the energized state during the descending period when there is the pressure reduction request, and iv) put the second drive mechanism in the non-energized state during the ascending period when there is the pressure reduction request.

7. The fuel pressure control device according to claim 6, wherein the electronic control unit is configured to start energization of the second drive mechanism within a latter half period of the ascending period, and the electronic control unit is configured to put the second drive mechanism in the energized state during the descending period.

8. The fuel pressure control device according to claim 6, wherein the electronic control unit is configured to stop energization of the second drive mechanism during the descending period, the electronic control unit is configured to put the second drive mechanism in the non-energized state during the ascending period.

9. The fuel pressure control device according to claim 6, wherein the first control valve includes a first valve body, a first valve seat portion having a first hole, the first valve seat portion being located at a position closer to the low-pressure passage than to the first valve body, a first biasing portion configured to bias the first valve body to the first valve seat portion so as to close the first hole, the first drive mechanism includes a first needle facing the first valve body through the first hole, a first needle biasing portion configured to bias the first needle to the first valve body, and a first coil configured to be switched to the energized state or the non-energized state to drive the first needle, and the first needle is configured such that the first needle is separated from the first valve body with magnetic force generated by the first coil in the energized state against biasing force of the first needle biasing portion and that the first needle presses the first valve body through the first hole such that the first valve body is separated from the first valve seat portion with the biasing force of the first needle biasing portion with the first coil in the non-energized state.

10. The fuel pressure control device according to claim 6, wherein the second control valve includes a second valve body, a second valve seat portion having a second hole, the second valve seat portion being located at a position closer to the compressing chamber than to the second valve body, and a second biasing portion configured to bias the second valve body to the second valve seat portion so as to close the second hole, the second drive mechanism includes a second needle facing the second valve body through the second hole, a second needle biasing portion configured to bias the second needle such that the second needle is separated from the second valve body, and a second coil configured to be switched to the energized state or the non-energized state to drive the second needle, and the second needle is configured such that the second needle presses the second valve body through the second hole such that the second valve body is separated from the second valve seat portion with magnetic force generated by the second coil in the energized state against the biasing force of the second needle biasing portion and that the second needle is separated from the second valve body with the biasing force of the second needle biasing portion with the second coil in the non-energized state.

11. A fuel pressure control device comprising:

a low-pressure pump configured to suck fuel in a fuel tank;

a low-pressure passage configured to receive the fuel supplied from the low-pressure pump;

a high-pressure pump configured to pressurize the fuel supplied from the low-pressure passage;

a high-pressure passage configured to receive the fuel supplied from the high-pressure pump;

a cylinder injection valve configured to receive the fuel supplied from the high-pressure passage to directly inject the fuel into a cylinder of an internal combustion engine, the high-pressure pump including a cylinder, a plunger configured to ascend and descend inside the cylinder in conjunction with driving of the internal combustion engine, a compressing chamber having a capacity decreased by the plunger ascending and increased by the plunger descending, a suction passage configured to provide communication between the low-pressure passage and the compressing chamber;

a discharge passage configured to provide communication between the compressing chamber and the high-pressure passage, a first control valve provided in the suction passage, the first control valve being configured to permit or prohibit communication of the fuel between the low-pressure passage and the compressing chamber, a second control valve provided in the discharge passage, the second control valve being configured to permit communication of the fuel from the compressing chamber to the high-pressure passage, and the second control valve being configured to restrict communication of the fuel from the high-pressure passage to the compressing chamber, a first drive mechanism configured to open or close the first control valve by energization control, and a second drive mechanism configured to open or close the second control valve by energization control; and an electronic control unit configured to i) determine whether the plunger is in a descending period during which the plunger is descending or the plunger is in an ascending period during which the plunger is ascending, ii) cause the first control valve to be closed by using the first drive mechanism during the descending period when there is a pressure reduction request to lower a fuel pressure inside the high-pressure passage, iii) cause the first control valve to be open by using the first drive mechanism during the ascending period when there is the pressure reduction request, and iv) maintain the second drive mechanism in the energized state during both the descending period and the ascending period when there is the pressure reduction request.

12. The fuel pressure control device according to claim 11, wherein the first control valve includes a first valve body, a first valve seat portion having a first hole, the first valve seat portion being located at a position closer to the low-pressure passage than to the first valve body, a first biasing portion configured to bias the first valve body to the first valve seat portion so as to close the first hole, the first drive mechanism includes a first needle facing the first valve body through the first hole, a first needle biasing portion configured to bias the first needle to the first valve body, and a first coil configured to be switched to the energized state or the non-energized state to drive the first needle, and the first needle is configured such that the first needle is separated from the first valve body with magnetic force generated by the first coil in the energized state against biasing force of the first needle biasing portion and that the first needle presses the first valve body through the first hole such that the first valve body is separated from the first valve seat portion with the biasing force of the first needle biasing portion with the first coil in the non-energized state.

13. The fuel pressure control device according to claim 11, wherein the second control valve includes a second valve body, a second valve seat portion having a second hole, the second valve seat portion being located at a position closer to the compressing chamber than to the second valve body, and a second biasing portion configured to bias the second valve body to the second valve seat portion so as to close the second hole, the second drive mechanism includes a second needle facing the second valve body through the second hole, a second needle biasing portion configured to bias the second needle such that the second needle is separated from the second valve body, and a second coil configured to be switched to the energized state or the non-energized state to drive the second needle, and the second needle is configured such that the second needle presses the second valve body through the second hole such that the second valve body is separated from the second valve seat portion with magnetic force generated by the second coil in the energized state against the biasing force of the second needle biasing portion and that the second needle is separated from the second valve body with the biasing force of the second needle biasing portion with the second coil in the non-energized state.

* * * * *